US005178049A

United States Patent [19]

Tsai-Hsin

[11] Patent Number: 5,178,049

[45] Date of Patent: Jan. 12, 1993

[54] PUNCHING MECHANISM

[76] Inventor: Huang Tsai-Hsin, No. 162-1, Sanchiao Rd., Pingho Tsun, Tatsun Hsiang, Changhua Hsien, Taiwan

[21] Appl. No.: 808,679

[22] Filed: Dec. 17, 1991

[51] Int. Cl.[5] ..... B26D 5/18; B26D 7/02

[52] U.S. Cl. ..... 83/164; 83/167; 83/387; 83/620; 83/630; 83/633; 83/468.8

[58] Field of Search ..... 83/164, 167, 382, 466.1, 83/468, 468.6, 468.7, 468.8, 468.9, 468.93, 468.94, 588, 620, 630, 386, 387, 388, 389, 633

[56] References Cited

U.S. PATENT DOCUMENTS

| | | | |
|---|---|---|---|
| 1,424,895 | 8/1922 | Girard et al. | 83/468.8 X |
| 1,692,764 | 11/1928 | Salt | 83/167 |
| 2,278,288 | 3/1942 | Sadler | 83/620 |
| 2,362,032 | 11/1944 | Smith | 83/620 |
| 2,449,108 | 9/1948 | Carlock | 83/387 |
| 2,814,346 | 11/1957 | Jauss | 83/620 |
| 4,294,152 | 10/1981 | Land | 83/620 X |
| 5,040,441 | 8/1991 | Tamura | 83/167 X |

*Primary Examiner*—Frank T. Yost
*Assistant Examiner*—Raymond D. Woods
*Attorney, Agent, or Firm*—Fitch, Even, Tabin & Flannery

[57] ABSTRACT

A punching device is provided that includes a frame disposed on a base and a pair of wall members, a lever having one end pivotally coupled between the wall members, a block slidably retained between the wall members by two plates and having an upper end linked to the lever a recess formed in the block, and a rod having an upper end fixed to the block and including a bore in communication with the recess of the block. The rod is movable downwardly by the lever to punch holes in paper, and provision is made for the residual of the paper to move through the bore of the rod, through the recess of the block, and into an access with a removable cover. A downwardly biased foot presses against the sheet materials on the base before the rod punches through the sheet materials. The base includes two interconnected support racks which are simultaneously adjustable.

1 Claim, 5 Drawing Sheets

PUNCHING MECHANISM

BACKGROUND OF THE INVENTION

1. Field of the Invention

The present invention relates to a punching mechanism.

2. Description of the Prior Art

Typical punching mechanisms include at least one rod which can be pressed downward by a handle in order to punch holes through paper. The residual of the paper is punched downwards through the holes formed in the base for supporting the paper by the rods.

The present invention has arisen to provide a novel punching mechanism.

SUMMARY OF THE INVENTION

The primary objective of the present invention is to provide a punching mechanism which can be operated effectively.

In accordance with one aspect of the invention, there is provided a punch including a base, a frame disposed on the base and including an access formed in the middle portion and including a pair of wall members extended forward therefrom, a lever having one end pivotally coupled between the wall member, a biasing means for biasing the other end of the lever upward, a block slidably disposed between the wall members of the frame and having an upper end coupled to the lever so that the block can be caused to move upwards and downwards by the lever, the block including a recess and a cavity formed therein and communicated with each other, the recess of the block being communicated with the access of the frame when the block moves upwards, a rod having an upper end engaged in the cavity of the block and including a bore longitudinally formed therein and communicated with the recess of the block, and a cover engaged on a rear portion of the frame so as to define a space with the frame, whereby, the rod can be pressed downward by the lever in order to punch holes in paper disposed on the base, and residual of the paper punched by the rod can move through the bore of the rod and the recess of the block and the access of the frame and can move into the space and can be collected within the space.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
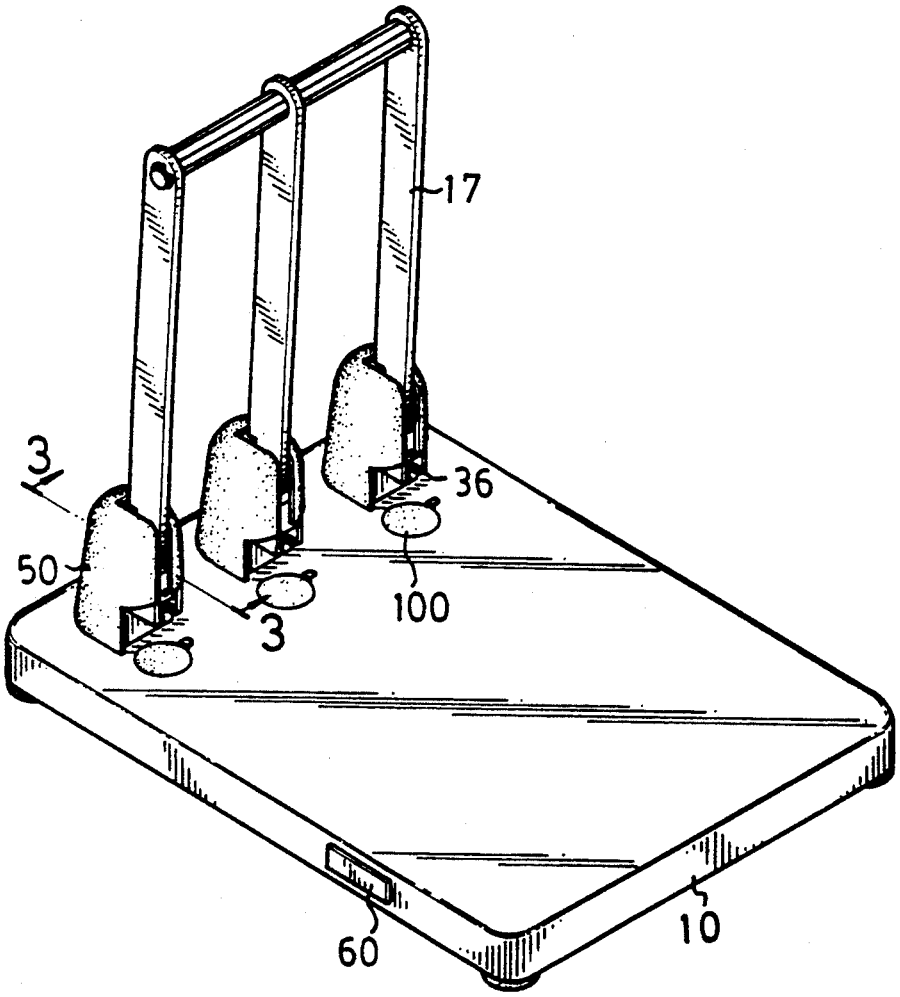
FIG. 1 is a perspective view of a punching mechanism in accordance with the present invention.
Figure 2:
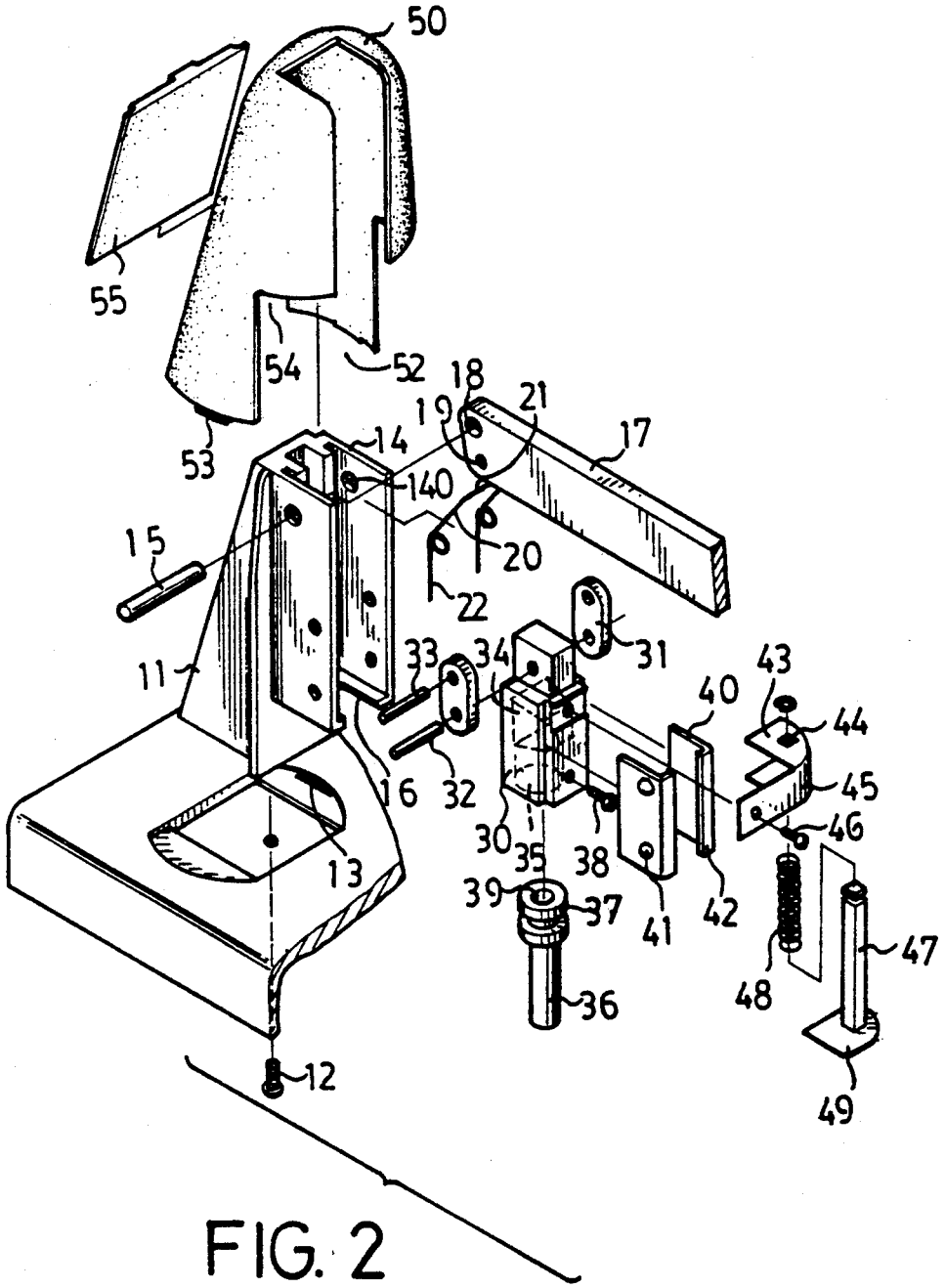
FIG. 2 is an exploded view of the punching mechanism.
Figure 3:
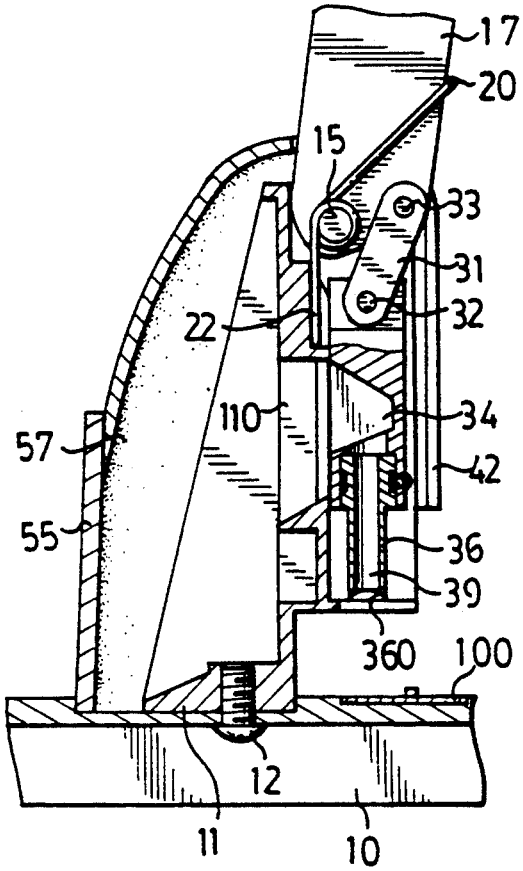
FIGS. 3 and 4 are cross sectional views taken along lines 3—3 of FIG. 1.

Referring to the drawings and initially to FIGS. 1 to 3, a punching mechanism in accordance with the present invention comprises generally a base 10 having six depressions 13 formed therein, three equally spaced frames 11 fixed on the base 10 by such as bolts 12, each of the frames 11 including a pair of wall members 14 extended forward therefrom, a shaft 15 fixed between the wall members 14, each of the wall members 14 having two holes 140 formed therein and having a flange 16 extended inwards from the bottom thereof, a lever 17 including two holes 18, 19 formed in the first end thereof. The shaft 15 extends through the hole 18 of the lever 17 so that the lever 17 Can be pivotally coupled to the frame 11. A spring 20 is engaged on the shaft 15 and includes a U-shaped portion 21 engaged with the lower surface of the lever 17 and two legs 22 engaged with the frame 11 so that the lever 17 can be biased upwards. The frame 11 includes an access 110 formed in the middle portion thereof.

A block 30 is slidable up and down between the wall members 14 of the frame 11 and includes an upper end pivotally coupled to the lower ends of two links 31 by an axle 32. The upper ends of the links 31 are pivotally coupled to the first end of the lever 17 by a pin 33 which extends through the hole 19 of the lever 17, so that the block 30 can be caused to move up and down by the lever 17. The block 30 includes a recess 34 and a cavity 35 formed therein and in communication with each other. The recess 34 is in communication with the access 110 of the frame 11 when the block 30 moves upward, as shown in FIG. 3. A rod 36 includes a head 37 engaged in the cavity 35 of the block 30 and fixed in place by a bolt 38 so that the block 30 and the rod 36 move in concert with each other. The rod 36 includes a bore 39 longitudinally formed therein and in communication with the recess 34 of the block 30 and includes a blade edge 360 formed in the perimeter of the bottom end thereof. Three pads 100 which are preferably made of rubber materials are disposed on the base 10 and located below the rods 36 respectively.

Figure 5:
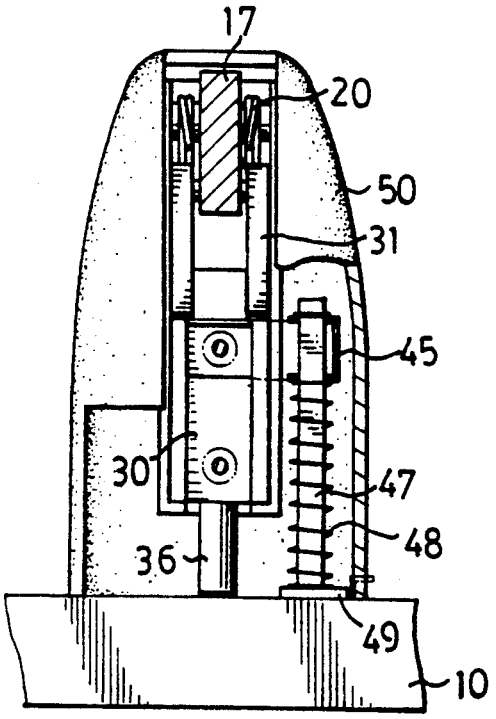
FIG. 5 is a cross sectional view taken along lines 5—5 of FIG. 7.

Two plates 40 each includes two protrusions 41 formed on the outer surface thereof for engagement with the holes 140 of the wall members 14 and includes a rib 42 extended inwards from the front portion thereof. The width of the block 30 and the thickness of the plates. 40 are arranged such that the plates 40 can be retained in place by engagement between the holes 140 and the protrusions 41 and such that the block 30 can be limited to move up and down and can be prevented from moving outwards of the wall members 14 by the ribs 42. A support 45 has a first end fixed to the block 30 by a bolt 46 and has two extensions 43 laterally formed on the second end thereof. Each of the extensions 43 has an orifice 44 formed therein. A post 47 has an upper end portion slidably extended through the orifices 44 of the extensions 43, 45 and includes a foot 49 fixed on the bottom thereof. A spring 48 is engaged on the post 47 and biased between the support 45 and the foot 49 for biasing the post 47 downwards, best shown in FIG. 5, so that the foot 49 can be biased to press against the paper disposed on the base 10.

A cover 50 includes an open front portion and an open bottom portion 52 and includes two hooks 53 formed on the bottom thereof for engagement with the depressions 13 of the base 10 so that cover 50 can be coupled to the base 10. The cover 50 includes a mouth 54 formed in the bottom and rear portion thereof and enclosed by a cap 55 by such as dovetail engagements.

The cover 50 is engaged on the rear portion of the frame 11 and forms a space 57 with the frame 11

Figure 4:
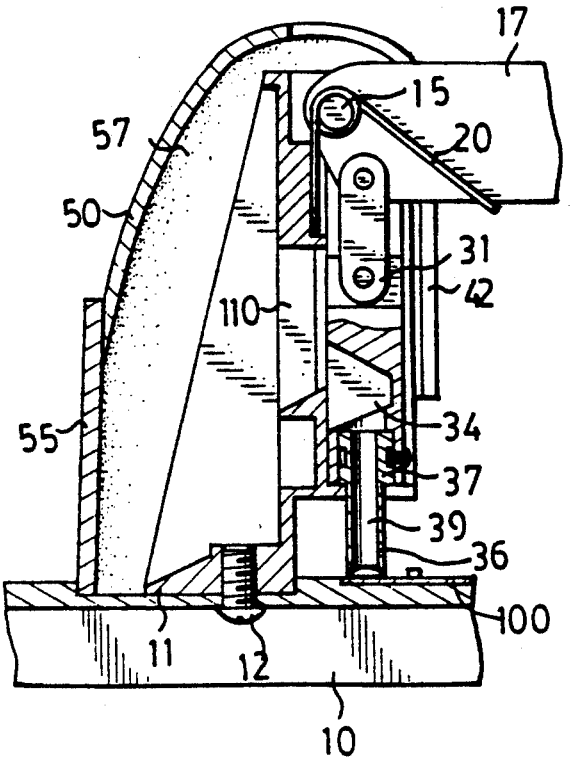

In operation, referring next to FIGS. 4, 5 and again to FIG. 3, the rod 36 can be pressed downward by the lever 17 when the lever 17 is pressed downward so that the paper disposed on the base 10 can be punched by the rods 36. The residual of the paper punched by the rods 36 will be caused to move upward along the bore 39 of the rod 36 and move into the space 57 via the recess 34 of the block 30 and the access 110 of the frame 11 so that the residual of the paper can be collected within the space 57. The residual of the paper can be discharged when the lid 55 is opened.

Figure 6:
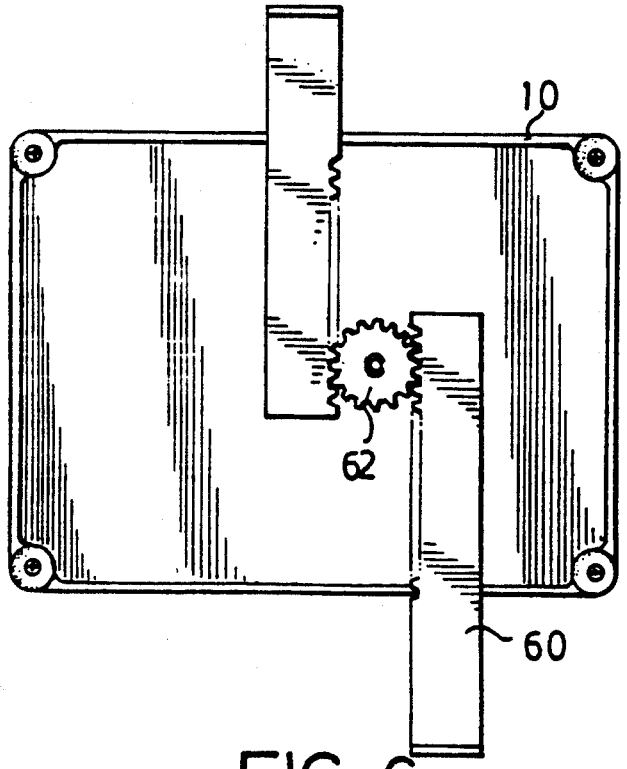
FIG. 6 is a bottom view of the punching mechanism.
Figure 7:
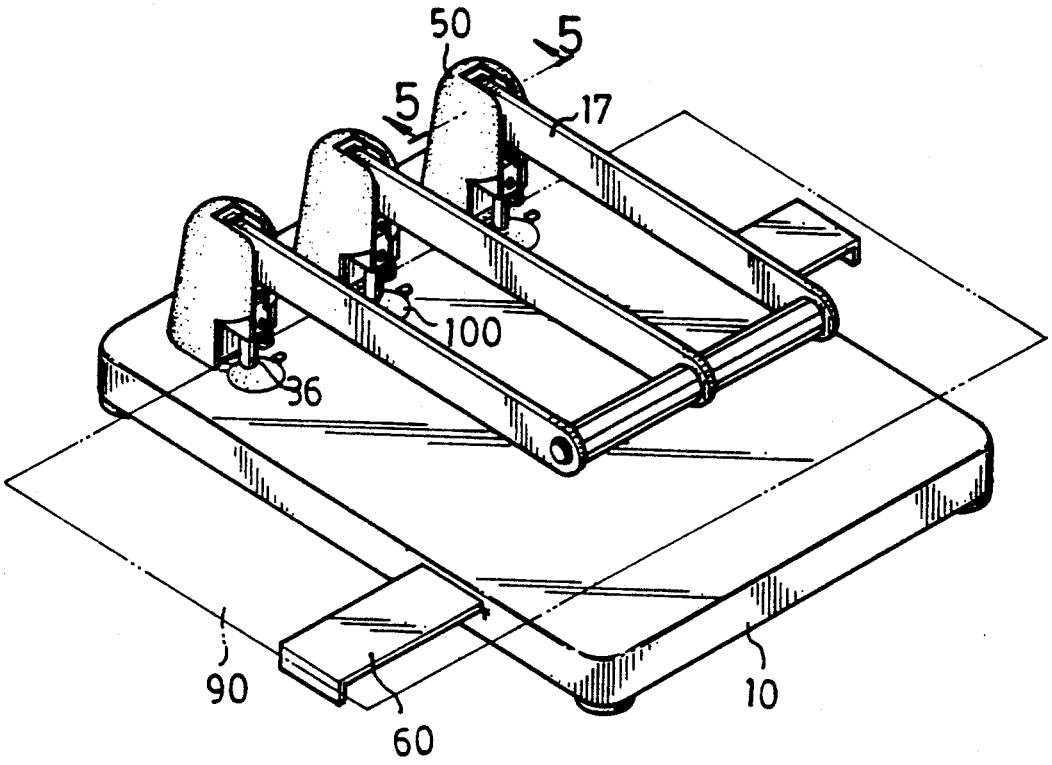
FIG. 7 is a perspective view similar to FIG. 1, illustrating the operation of the punching mechanism.

Referring next to FIGS. 6 and 7, two racks 60 each has an outer end extendible oppositely outward beyond the base 10 and has an inner end located within the base 10. A gear 62 is rotatably disposed in the base 10 and engaged with the racks 60 simultaneously so that the racks 60 can be caused to move outwards and inwards of the base 10 simultaneously. When the racks 60 are moved outwards of the base 10, paper 90 of larger size can be stably supported by the base 10 and the racks 60.

Accordingly, the punching mechanism in accordance with the present invention has a novel configuration and can be operated effectively.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A punching mechanism for sheet materials comprising a base including a first side; at least one frame disposed on said first side of said base and including an access formed in a middle portion thereof and a pair of wall members extended forward therefrom; a lever having a first end pivotally coupled between said wall members and including a second end; a biasing means for biasing said second end of said lever upwards; a block slidably disposed between said wall members of said frame and including an upper end; at least one link including a lower end pivotally coupled to said upper end of said block and including an upper end pivotally coupled to said lever to cause upward and downward movements of said lever, said block including a recess and a cavity formed therein and in communication with each other, said recess of said block being in communication with said access of said frame when said block moves upwards, and each of said wall members including at least one hole formed therein; two plates each disposed between said block and a respective wall member and including at least one protrusion formed on an outer surface thereof for engagement with said hole of said wall members to retain said plates in place, and each of said plates including a rib extended inwards from a front portion thereof for engagement with said block to prevent said block from moving outward of said wall members; a rod for punching said sheet materials, said rod having an upper end engaged in said cavity of said block and including a bore longitudinally formed therein and in communication with said recess of said block; a a cover engaged on a rear portion of said frame to define a space with said frame, said cover including two hooks formed on a bottom thereof, said base including two depressions formed therein for engagement with said hooks of said cover to provide for coupling said cover to said base, said cover including a mouth formed in a rear and lower portion thereof, and a cap provided for enclosing said mouth to permit removal of residual of said sheet materials when punched by said rod; a support including a first end fixed to said block so that said support moves in concert with said block and including at least one extension laterally formed on a second end thereof, said extension having an orifice formed therein; a post carried by said extension parallel to and spaced from said rod and having an upper end portion slidably extended through said orifice of said extension, said post including a foot fixed on a bottom thereof; a spring engaged on said post to create a bias between said support and said foot to bias said post downwards to press against said sheet materials on the base before said rods punch said sheet materials; a pair of parallel racks each including an outer end extendible oppositely outward beyond said base and including an inner end located within said base; and a gear rotatably disposed in said base and engaged with said racks simultaneously so that said racks are caused to move outwards and inwards of said base simultaneously, whereby when said rod is pressed downward by said lever to punch holes in said sheet materials, residual of said sheet materials punched by said rod moves upward through said bore of said rod and said recess of said block and said access of said frame and into said space and is collected within said space.

* * * * *

UNITED STATES PATENT AND TRADEMARK OFFICE

CERTIFICATE OF CORRECTION

PATENT NO. : 5,178,049

DATED : January 12, 1993

INVENTOR(S) : Tsai-Hsin HUANG

It is certified that error appears in the above-identified patent and that said Letters Patent is hereby corrected as shown below:

IN THE ABSTRACT:

On the face of the patent, under the heading entitled, "ABSTRACT", line 6, after the word "lever" insert a comma --,--.

Column 2, line 11, change "Can" to read --can--.

Column 2, line 45, after the word "plates" delete the period ".".

Column 3, line 2, after the numeral "11" insert a period --.--.

IN THE CLAIMS:

Column 4, line 15 (Claim 1, line 31), delete "a" (first occurrence).

Signed and Sealed this

Sixteenth Day of November, 1993

*Attest:*

Bruce Lehman

BRUCE LEHMAN

*Attesting Officer*

*Commissioner of Patents and Trademarks*